US005228789A

United States Patent [19]

Starr et al.

[11] Patent Number: 5,228,789

[45] Date of Patent: Jul. 20, 1993

[54] INKED RIBBON DEVICE FOR LINE PRINTERS

[75] Inventors: David G. Starr, Renton; Erik Bylund, Kent; Greg Peterson, Puyallup, all of Wash.

[73] Assignee: Mannesmann Aktiengesellschaft, Düsseldorf, Fed. Rep. of Germany

[21] Appl. No.: 813,146

[22] Filed: Dec. 23, 1991

[30] Foreign Application Priority Data

Dec. 21, 1990 [DE] Fed. Rep. of Germany ..... 4041991

[51] Int. Cl.[5] ..... B41J 33/14

[52] U.S. Cl. ..... 400/224; 400/208; 400/248; 400/196

[58] Field of Search ..... 400/194, 196, 207, 208, 400/208.1, 211, 212, 242, 243, 246, 248, 224

[56] References Cited

U.S. PATENT DOCUMENTS

| | | | |
|---|---|---|---|
| 4,313,683 | 2/1982 | Brown et al. | 400/248 |
| 4,402,621 | 9/1983 | Abell, Jr. et al. | 400/248 |
| 4,801,215 | 1/1989 | Paffhausen et al. | 400/224 |
| 4,826,334 | 5/1989 | Surti | 400/224 |
| 5,039,237 | 7/1991 | Tanuma et al. | 400/124 |

FOREIGN PATENT DOCUMENTS

| | | | |
|---|---|---|---|
| 0175010 | 3/1986 | European Pat. Off. | 400/224 |
| 0258783 | 11/1986 | Japan | 400/239 |
| 0059583 | 3/1988 | Japan | 400/239 |

OTHER PUBLICATIONS

"Soft Sensing End of Ribbon", Research Disclosure, Jun. 1989, No. 302; Kenneth Mason Publications Ltd., England.

Caudill et al., "Disposal of Typewriter Ribbon", IBM Technical Disclosure Bulletin vol. 8 No. 8 Jan. 1966.

*Primary Examiner*—Edgar S. Burr
*Assistant Examiner*—Lynn D. Hendrickson
*Attorney, Agent, or Firm*—Horst M. Kasper

[57] ABSTRACT

An adaptation of an inked ribbon cassette to printers of higher printing speed is achieved where a supply spool is used as inked ribbon storage. Furthermore, the problem of an environmentally proper disposal of used inked ribbon cassettes is solved. At least two rotary drivable spool axles (3, 4) are spaced apart from each other on a base plate (1), open toward the upper side and open on the bottom side, where the spool axles (3, 4) are rotary supported on the base plate (1). The inked ribbon reels (2, 5) can be individually attached onto the spool axles (3, 4). A first inked ribbon guide element (7) is coordinated to one spool axle (3, 4). The inked ribbon (6) is guided from a first inked ribbon reel (2) along the first inked ribbon guide element (7) and parallel to the print path (17) and back via a second inked ribbon guide element (8) onto the second inked ribbon reel (5). In each case, a controllable electrical drive motor (9) is disposed on each spool axle (3, 4) at the bottom side (1*a*) of the base plate (1).

21 Claims, 3 Drawing Sheets

INKED RIBBON DEVICE FOR LINE PRINTERS

BACKGROUND OF THE INVENTION

1. Field of the Invention

The invention relates to an inked ribbon cassette, in particular for line printers, including a base plate, at least one inked ribbon storage and a guide for the inked ribbon, wherein the inked ribbon storage is furnished by a supply reel.

2. Brief Description of the Background of the Invention Including Prior Art

Such inked ribbon cassettes serve for storing an as large as possible volume of inked ribbon, in order to achieve a production as large as possible of printed pages with a printer of a serial construction and of a line construction. The storing of a large volume of inked ribbon corresponds also to the desires of the user, namely to perform a change of the inked ribbon cassette as rarely as possible. In addition, the change of the inked ribbon cassette is not always associated with the expected knowledge that a person of ordinary skill endeavors to limit the change to the most necessary handling steps by the operating personnel.

On the other hand, the printing rate of the printers such as, for example, of the matrix printers increases continuously in the course of time such that in the course of the development of the printers, the inked ribbon cassette was originally transported together with the print head on the print head slider and, later, there was created a spatially fixed inked ribbon cassette, where the inked ribbon storage is correspondingly larger. However, the volume of the inked ribbon storage cannot be increased arbitrarily because the space required for such volume of inked ribbon is not available in the printing apparatus and, on the other hand, handling the contents of such inked ribbon cassettes becomes more and more difficult.

The discharging and sanitary disposition of the inked ribbon cassettes represents a particular problem. No functioning system exists at this time which allows to dispose of inked ribbon cassettes in an effective manner, as well as of their contents, i.e., the inked ribbon, where the inked ribbon cassettes have been produced with injection molding tools from plastic. It is to be considered in this context that individual inked-ribbon-cassette producers produce daily 500,000 inked ribbon cassettes of all kinds and all dimensions, which are delivered after filling with the inked ribbon to dealers or, respectively, end consumers. In general, it is assumed that the operator of a printer requires annually from about 6 to 7 inked ribbon cassettes. Thus, each printer uses 6 to 7 inked ribbon cassettes annually, which have to be disposed of in an environmentally sound manner. It has now been shown that such a waste disposal could only be performed to the effect that the used inked ribbon is removed from the respective inked ribbon cassette and that the casing of the inked ribbon cassette is melted down again and that inked ribbon cassettes are produced again by the manufacturer. However, it cannot be assumed that such a system would exist or would even properly function and operate. First, already the waste disposal of the inked ribbon from the inked ribbon cassette casing is an economic problem. Then, the return of the inked ribbon cassette casing would also be an economic problem and the reprocessing, i.e., the melting down and the comminution and the re-supply at the producer plant would present an economic and technical problem. Thus, one has to assume after comprehensive considerations that such a recycling system cannot be employed effectively.

Such inked ribbon cassettes are, for example, known from the German Petit Patent DE-GBM 84 08 998.0. This conventional item includes a tensioning device for an inked ribbon disposed in a cassette. The conventional construction is therefore coinciding with the above-recited kind because a supply reel is employed as an inked ribbon storage. It is known to employ a hollow cylinder, rotatable under tension in the cassette casing, as hub of a reel of the supply reel, where the hollow cylinder is slipped over a pin attached to the cassette. A drag spring is disposed between the pin and the hollow cylinder in order to exert a corresponding tension onto the inked ribbon or, respectively, in order to avoid a slacking of the inked ribbon. Such a construction is however not useful, neither with respect to the requirements for a high-power and high-performance printer nor with respect to the problems associated with the disposal of the used product.

SUMMARY OF THE INVENTION

1. Purposes of the Invention

It is an object of the present invention to furnish an inked ribbon cassette, which can be employed in a modern high performance printer and which resolves simultaneously the problem of disposing of the ribbon support plastic.

It is another object of the invention to provide an effective and easy system for allowing a change of inked ribbon cassettes in a matrix printer.

It is yet a further object of the present invention to provide an economic solution of furnishing inked ribbon cassettes to a printer by avoiding the continuous requirement of employing new cassettes in connection with a matrix pin printer.

These and other objects and advantages of the present invention will become evident from the description which follows.

2. Brief Description of the Invention

According to the present invention there, is provided for an inked ribbon cassette. A base plate is accessible from an upper side of the base plate and toward a bottom side of the base plate. A first drivable spool axle is supported on the base plate and is rotatably supported on said base plate. An inked ribbon reel is attachable onto the first drivable spool axle. A first controllable, electrical drive motor is disposed on the first spool axle at the bottom side of the base plate. A first inked ribbon guide element is attached to the base plate and coordinated to the first spool axle for guiding an inked ribbon otherwise surrounding the first drivable spool axle along the first inked ribbon guide element and parallel to a print path. A second drivable spool axle is supported on the base plate, spaced apart from the first drivable spool axle and rotatably supported on said base plate. The inked ribbon reel is attachable onto the second drivable spool axle. A second controllable, electrical drive motor is disposed on the second spool axle at the bottom side of the base plate. A second inked ribbon guide element is attached to the base plate and coordinated to the second spool axle for guiding the inked ribbon otherwise surrounding the second drivable spool axle along the second inked ribbon guide element and parallel to said print path.

A mounting plate of a line printer can be attached to the base plate.

A first inked ribbon storage reel can be attached to the first spool axle. The first inked ribbon guide element can guide the inked ribbon from the first inked ribbon reel. A second inked ribbon storage reel can be attached to the second spool axle. The second inked ribbon guide element can guide the inked ribbon to the second inked ribbon reel. The print path can be defined by a substantially straight line.

A control element, attached to the base plate, can furnish a respective recognition of a start end and an end of the inked ribbon.

A control circuit can actuate the first electric drive motor and the second electric drive motor.

A printed circuit board can support the control circuit. The printed circuit board can be attached at the bottom side of the base plate. The control circuit can be furnished as an integrated circuit and can be supported on the printed circuit board.

A mounting plate of a line printer can be attached to the base plate. The base plate can be disposed at an angle relative to the mounting plate. The angle can be determined by utilization of the full usable inked ribbon width by the print elements to the length of a print path.

A mounting plate of a line printer can be attached to the base plate. The base plate can be disposed at an angle relative to the mounting plate. The sin of the angle can be determined by a ratio of the difference of the usable width of the ribbon less maximum height of individual print characters divided by the maximum length of the print lines.

A mounting plate of a line printer can be attached to the base plate. A pair of protrusions can protrude from the mounting plate and can have a height corresponding to the desired course of the base plate relative to the mounting plate. The base plate and the mounting plate can be disengageably attached to each other.

Tilting locking arms can be furnished at the spool axles for support and attachment of the inked ribbon reels.

The inked ribbon guide elements can be furnished in each case by mold bodies. The mold bodies can delimit in each case the print path of a print head and can form sliding faces and guide indentations for the inked ribbon.

In accordance with the present invention, at least two rotary-driven spool axles are disposed at a distance at a base plate accessible from the upper side and accessible from the bottom side. The reel axles are rotary supported. Individually inked ribbon reels can be attached to the spool axles. A first inked ribbon guide element is coordinated to one spool axle. The inked ribbon is guided from a first inked ribbon reel along the first inked ribbon guide element and parallel to the print path and back via a second inked ribbon guide element to the second inked ribbon reel. An in each case automatically controllable electrical drive motor is disposed on each spool axle at the bottom and underside of the base plate. Such a system advantageously meets the requirements of a high performance printer by automatically controlling electrically or, respectively, electronically the tension of the inked ribbon train in such a fine and sensitive way via the two drive motors that the inked ribbon advance speed can be adapted to the printing situations prevailing at each point in time. Then this system is associated with the unusual and excellent advantage of a possibility of properly disposing of a used element. The conventional inked ribbon cassette casings are completely avoided such that a disposal of the used inked ribbon casings is completely eliminated. The residual waste disposal of the inked ribbon itself is limited to a first ribbon reel, which can be refilled in the production facility for the inked ribbon without any technical and economic difficulties. Thus, the invention system represents an optimum solution for the required technical functions as well as for an environmentally proper disposal of the inked ribbon cassette.

Based on the respectively given diameter of an inked ribbon reel with an inked ribbon, both a movement reversal as well as the exchange of a used inked ribbon can be advantageous. It is provided for this purpose that a control is furnished for the recognition of the start or, respectively, of the end of the inked ribbon.

It is furthermore advantageous that the electrical drive motors can be actuated by way of a control circuit. This control circuit can therefore now be integrated into the inked ribbon cassette.

A further advantage results from the structure that the control circuit is disposed as an integrated circuit on a printed circuit board which is attached at the bottom side of the base plate.

On the one hand, the complete inked ribbon cassette is completely independent from the remaining printer apparatus relating to control techniques and, secondly, the printed circuit board is disposed at a protected position.

It is further advantageous that the base plate is disposed at an angle relative to the mounting plate, which angle is determined by the print elements to the length of the print path during use of the full width of the inked ribbon. Advantageously, the inked ribbon is completely employed by using an inclined position of the height which represents a principle that can also be employed here in connection with the simple system of a base plate.

According to further features of the invention there is provided that pairs of protrusions, having a height level corresponding to the course of the base plate relative to the mounting plate, are attached on the mounting plate and that the base plate and the mounting plate are disengageably attached to each other. This system allows to set a fixed angle between the base plate and the mounting plate.

A further improvement of the invention provides that the axles of the spools are furnished with tiltable locking arms for the support and the attachment of the inked ribbon reels. Thus, the inked ribbon reels can be incorporated and removed in a simple way by the operating personnel.

A further development of the invention provides that the inked ribbon guide elements comprise in each case molded bodies, delimiting the print path of a print head, as well as molded bodies forming sliding faces and guide indentations and slots for the inked ribbon.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

Other characteristics and advantages of the invention are set forth in the description which follows below and in the annexed drawings, in which.

DESCRIPTION OF INVENTION AND PREFERRED EMBODIMENTS

Figure 1:
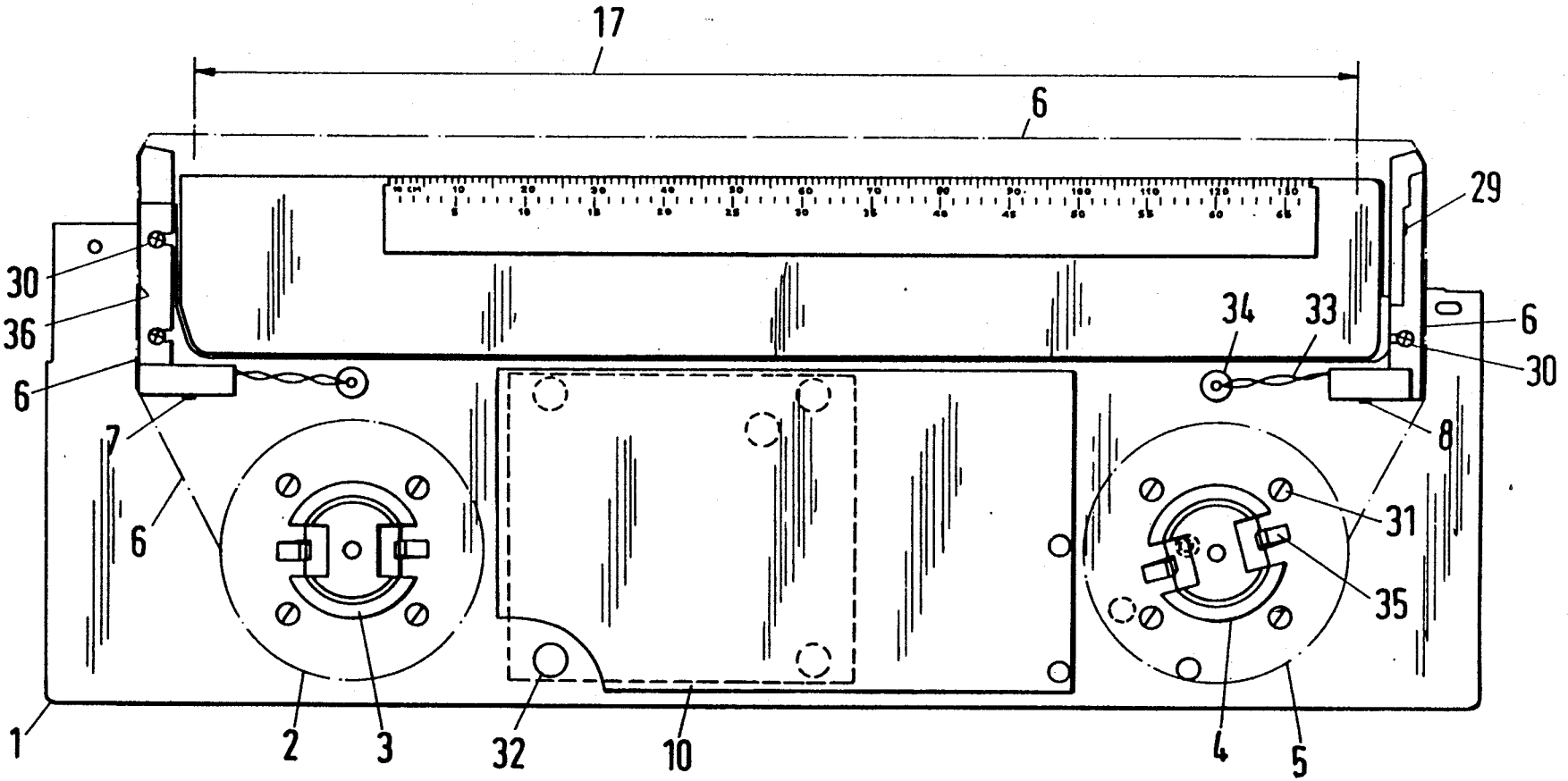
FIG. 1 shows a top plane view onto an open inked ribbon cassette.

According to the present invention, there is provided for an inked ribbon cassette, in particular for line printers, with a base plate, with at least one inked ribbon storage, and a guide for the inked ribbon. The inked ribbon storage is furnished by a supply reel. At least two drivable spool axles 3, 4 are spaced apart from each other on a base plate 1, accessible from the upper side and toward the bottom side. The spool axles 3, 4 are rotatably supported on said base plate 1. The inked ribbon reels 2, 5 are attachable onto the spool .axles 3, 4. A first inked ribbon guide element 7 is coordinated to one spool axle 3, 4. The inked ribbon 6 is guided from a first inked ribbon reel 2 along the first inked ribbon guide element 7 and parallel to the print path 17 and back via a second inked ribbon guide element 8 to the second inked ribbon reel 5. In each case a controllable, electrical drive motor 9 is disposed on each spool axle 3, 4 at the bottom side 1*a* of the base plate 1.

A control element 11 can be furnished for the recognition of the start of the inked ribbon or, respectively, of the end of the inked ribbon.

The electric drive motors 9 can be actuated with a control circuit 10.

The control circuit 10 can be furnished as an integrated circuit 12 and can be disposed on a printed circuit board 13. The printed circuit board 13 can be attached at the bottom side 1*a* of the base plate 1.

The base plate 1 can be disposed at an angle 14 relative the mounting plate 15. A mounting plate of a line printer is attached to the base plate, wherein the base plate is disposed at an angle relative to the mounting plate. The angle 14 can be determined, by utilization of the full inked ribbon width 16, by the print elements to the length of a print path 17.

Projections 18, 118, 228 can have a height such as shown at reference numeral 19 corresponding to the course of the base plate 1 relative to the mounting plate 15 and can be attached on the mounting plate 15. The base plate 1 and the mounting plate 15 can be disengageably attached to each other.

The spool axles 3, 4 can be furnished with tilting locking arms 35 for support and attachment of the inked ribbon reels 2, 5.

The inked ribbon guide elements 7, 8 can be furnished in each case by mold bodies 38. The mold bodies 38 can delimit in each case the print path 17 of a print head and can form sliding faces 36 and guide indentations 37 for the inked ribbon 6.

In accordance with the present invention there is provided an inked ribbon cassette, structured and formed both for a serial as well as a line printer. The inked ribbon cassette is furnished with a base plate 1 and a storage for the inked ribbon. The storage for the inked ribbon is formed by a first inked ribbon reel 2. Two drivable spool axles 3 and 4 are rotary supported on the base plate 1, disposed upright and spaced apart on the base plate 1 at a distance adapted to the size of the apparatus. The base plate 1 is open both toward the upper side and the bottom side. The first inked ribbon reel 2 and a second inked ribbon reel 5 are attachable onto these spool axles 3 and 4. An inked ribbon guide element is coordinated sideways to each spool axle 3 and 4 such as to guide an inked ribbon 6. Thus, a first inked ribbon.guide element 7 is disposed on the outside at the inked ribbon reel 2 and a second inked ribbon guide element 8 is disposed at the inked ribbon reel 5.

Figure 4:
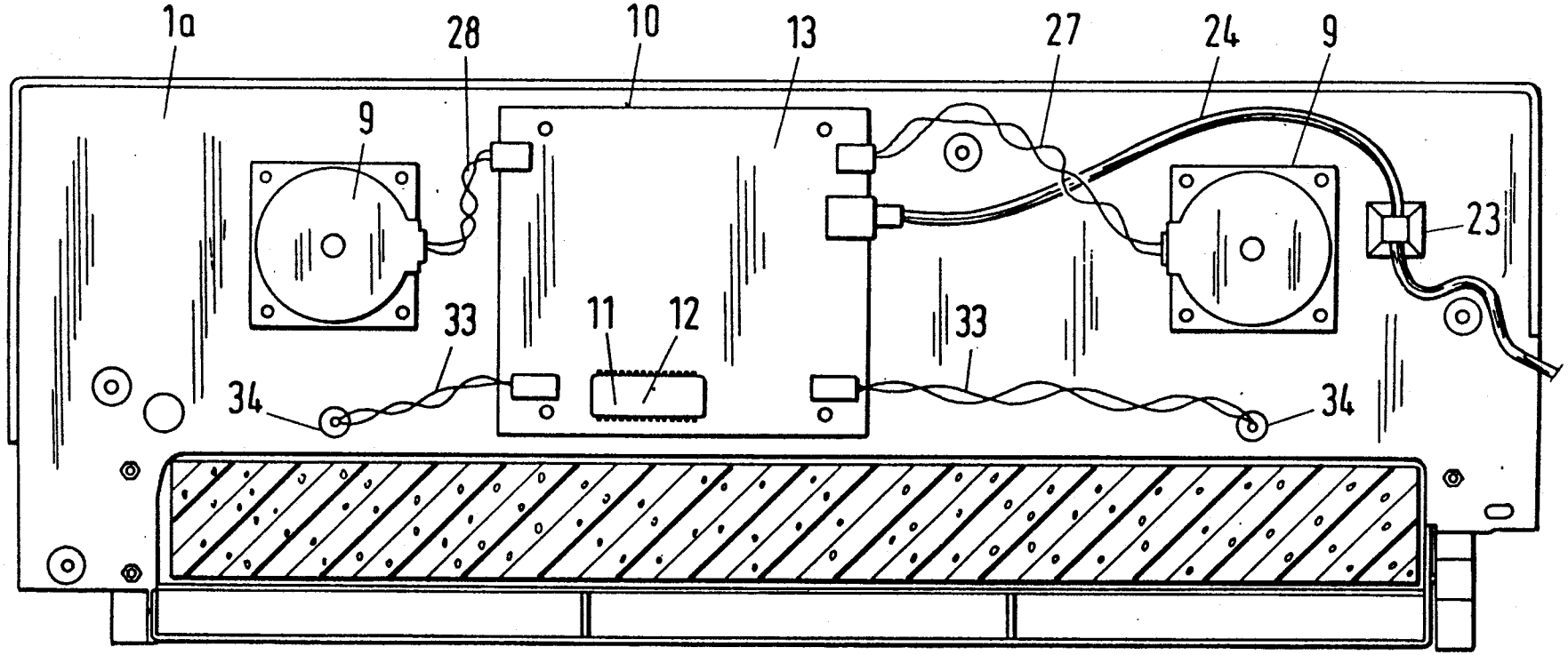
FIG. 4 shows a bottom view of the base plate corresponding to the section line A—A of FIG. 2.

In each case, a controllable drive motor 9 is disposed on each spool axle 3 and 4 at the bottom side 1*a*, as seen in FIG. 4, of the base plate 1. The two drive motors 9 can be provided by step motors. The drive motors 9 can be actuated by way of an automatic control circuit 10. The automatic control circuit 10 comprises also a control element 11 for detecting the initial end or start of the inked ribbon or, respectively, of the end of the inked ribbon, such that the speed, the cycle times, the pull tension and like parameters can be automatically controlled.

The control circuit 10 is disposed as an integrated circuit 12, including a microprocessor, on a printed circuit board 13. The printed circuit board 13 is disposed at the bottom side 1*a* of the base plate 1. As can be gathered from the following, this disposition and location of the printed circuit board 13 next to the drive motor 9 is not only advantageous with respect to conductor circuitry, but is also advantageous in view of an easily accessible protective space.

Figure 2:
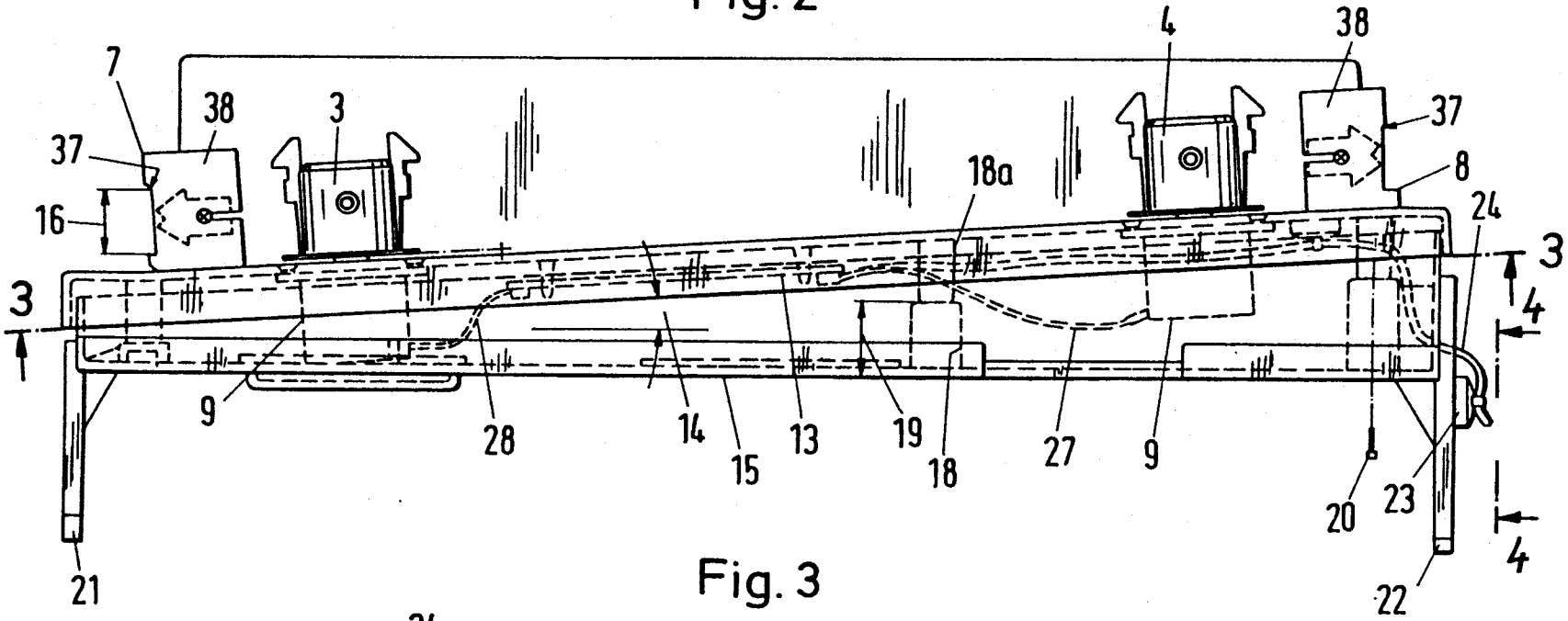
FIG. 2 shows a side elevational view of a base plate with a mounting plate.
Figure 3:
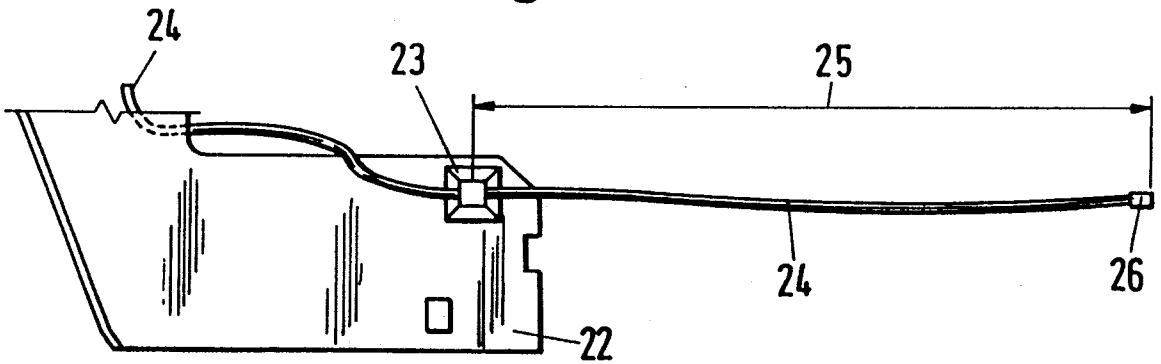
FIG. 3 shows a detailed view of the cable guide as seen in the direction B—B of FIG. 2.

The base plate 1 is in fact, dependent on the width 16 of the inked ribbon 6, disposed at an angle 14, as illustrated in FIG. 2, relative to the mounting plate 15. Upon utilization of the full width of the inked ribbon 16 by the print element, such as, for example, print wires, print pins, electrodes, and the like, over the length of one print path 17, there results an angle 14, illustrated in FIG. 1. The size of the angle 14 is determined by the ratio of the width of the inked ribbon to be used relative to and/or divided by the length of the print, i.e. the printable width on the paper used. Pairs of first protrusions 18, 118 and 228 having a height such as shown at reference numeral 19 corresponding to the course of the base plate 1, relative to the mounting plate 15, are disposed on the mounting plate 15. Corresponding second protrusions 18*a*, 118*a* and 228*a* are protruding at the base plate 2 in order to define and determine the angle 14. Screws 20 are passing through the first protrusions 18, 118 and 228 of the mounting plate 15 and the second protrusions 18*a*, 118*a* and 228*a* of the base plate 1 in order to disengageably connect the base plate and the mounting plate 15. The total unit of the base plate 1 and the mounting plate 15 is inserted via side walls 21 and 22 into the respective printer and is correspondingly bolted and locked at the respective printer.

A cable support 23 is, for example, attached at the side wall 22. A cable 24, having a length 25, is furnished for a plug connection 26 in order to initiate and furnish the complete energy supply of the inked ribbon cassette from the printer. The cable 24 is then guided to the printed circuit board 13 and transfers also the current supply or, respectively, the control energy for the drive motors 9 through further cables 27 and 28, starting from the printed circuit board 13.

The inked ribbon guide elements 7 and 8 are attached by way of screws 29 and 30 on the base plate 1. A support plate for the spool axles 3 and 4 is also connected by way of screws 31. Suitable supports 32 maintain the printed circuit board 13 insulated.

Conductor wires 33 are led to contacts 34 from the printed circuit board 13, i.e., from the control circuit 10, as illustrated in FIG. 4.

The spool axles 3 and 4 are furthermore in each case furnished with tiltable locking arms 35 for the support and the attachment of the inked ribbon reels 2 and 5. The inked ribbon guide elements 7 and 8 form guide surfaces 36 and guide indentations 37, which are disposed at separate molded bodies 38.

It will be understood that each of the elements described above, or two or more together, may also find a useful application in other types of ribbon cassettes differing from the types described above.

While the invention has been illustrated and described as embodied in the context of an inked ribbon cassette, in particular for line printers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to the protected by Letters Patent is set forth in the appended claims.

1. An inked ribbon device comprising a base plate accessible from an upper side of the base plate and accessible from a bottom side of the base plate;

a first drivable spool axle rotatably supported on said base plate, wherein a first inked ribbon reel is attachable onto the first drivable spool axle;

a first controllable, electrical drive motor disposed on the first spool axle at the bottom side of the base plate;

a first inked ribbon guide element attached to the base plate and coordinated to the first spool axle for guiding an inked ribbon surrounding the first drivable spool axle along the first inked ribbon guide element and parallel to a print path;

a second drivable spool axle rotatably supported on the base plate, spaced apart from the first drivable spool axle, wherein a second inked ribbon reel is attachable onto the second drivable spool axle;

a second controllable, electrical drive motor disposed on the second spool axle at the bottom side of the base plate;

a second inked ribbon guide element attached to the base plate and associated with the second spool axle for guiding the inked ribbon surrounding the second drivable spool axle along the second inked ribbon guide element and parallel to said print path;

a mounting plate of a line printer attached to the base plate and extending toward the mounting plate;

first protrusion disposed on the base plate;

second protrusions disposed on the mounting plate and extending toward the base plate cooperable with said first protrusion for adjusting the height level between the base plate and the mounting plate and for defining an angle between the mounting plate and the base plate.

2. The inked ribbon device according to claim 1 further comprising a first inked ribbon storage reel attached to the first spool axle, wherein the first inked ribbon guide element guides the inked ribbon from the first inked ribbon reel;

a second inked ribbon storage reel attached to the second spool axle, wherein the second inked ribbon guide element guides the inked ribbon to the second inked ribbon reel, and wherein the print path is defined by a substantially straight line.

3. The inked ribbon device according to claim 2 further comprising a control element attached to the base plate and furnished for detecting an initial start end of the inked ribbon and of an end of the inked ribbon, respectively.

4. The inked ribbon device according to claim 1 further comprising a control circuit for actuating the first electric drive motor and the second electric drive motor.

5. The inked ribbon device according to claim 4 further comprising a printed circuit board supporting the control circuit, wherein the printed circuit board is attached at the bottom side of the base plate, and wherein the control circuit is furnished as an integrated circuit and supported on the printed circuit board.

6. The inked ribbon device according to claim 1 wherein the angle is determined by utilization of a full usable of the inked ribbon width by the print elements to the length of a print path.

7. The inked ribbon device according to claim 1 further comprising an inked ribbon disposed between the first inked ribbon wheel and the second inked ribbon wheel; wherein the trigonometrical sine function of the angle is determined by a ratio of the difference of the usable width of the ribbon less maximum height of individual print characters divided by the maximum length of the print lines.

8. The inked ribbon device according to claim 1 further comprising said pair of second protrusions protruding from the mounting plate and having a height corresponding to the desired course of the base plate relative to the mounting plate, wherein the base plate and the mounting plate are disengagably attached to each other.

9. The inked ribbon device according to claim 1 further comprising tilting locking arms furnished at the spool axles for support and attachment of the inked ribbon reels.

10. The inked ribbon device according to claim 1, wherein the inked ribbon guide elements are molded, wherein inked ribbon guide elements define in each case the print path of a print head and form the guide means and guide indentations for the inked ribbon.

11. The inked ribbon device according to claim 1, wherein the mounting plate and the base plate form an insertable unit.

12. The inked ribbon device according to claim 11, further comprising attachment elements attaching the protrusions in the mounting plate to the protrusions on the base plate.

13. The inked ribbon device according to claim 12, wherein the attachment elements are screws passing through a hole in the protrusions on the mounting plate and engaging a threaded bore on the protrusions on the base plate.

14. An inked ribbon device, in particular for line printers, with a base plate, with at least one inked ribbon storage and a guide for the inked ribbon, wherein the inked ribbon storage is furnished by a supply spool, wherein at least two drivable spool axles (3, 4) are spaced apart from each other on a base plate (1), accessible from the upper side and toward the bottom side, and wherein the spool axles (3, 4) are rotatably supported on said base plate (1), wherein a first and a second inked ribbon reels (2, 5) are attachable onto the spool axles (3, 4), wherein a first inked ribbon guide element (7) is coordinated to one spool axle (3, 4), wherein the inked ribbon (6) is guided from the first inked ribbon reel (2) along the first inked ribbon guide element (7) and inclined at an angle relative to the print path (17) and back via a second inked ribbon guide element (8) to the second inked ribbon reel (5), and wherein in each case a controllable, electrical drive motor (9) is disposed on each spool axle (3, 4) at the bottom side (1*a*) of the base plate (1), a mounting plate, wherein the base plate (1) is disposed at an angle (14) relative to the mounting plate, and wherein first protrusions are provided on the mounting plate and extending toward the mounting plate and wherein second protrusions are provided on the mounting plate and extending toward the base plate and wherein said second protrusions are abutting the first protrusions at the base plate for defining the angle, and wherein the base plate and the mounting plate form an insertable unit.

15. The inked ribbon device according to claim 14, wherein a control element (11) is furnished for the recognition of the start of the inked ribbon or, respectively, of the end of the inked ribbon.

16. The inked ribbon device according to claim 14, wherein the electric drive motors (9) are actuatable with a control circuit (10).

17. The inked ribbon device according to claim 16, wherein the control circuit (10) is furnished as an integrated circuit (12) and disposed on a printed circuit board (13), and wherein the printed circuit board (13) is attached at the bottom side (1*a*) of the base plate (1).

18. The inked ribbon device according to claim 14, wherein the angle (14) is determined, by utilization of the full inked ribbon width (16), by the print elements to the length of a print path (17).

19. The inked ribbon device according to claim 14, wherein projections (18) have a height (19) corresponding to the course of the base plate (1) relative to the mounting plate (15) and are attached on the mounting plate (15), and wherein the base plate (1) and the mounting plate (15) are disengagably attached to each other.

20. The inked ribbon device according to claim 14, wherein the spool axles (3, 4) are furnished with tilting locking arms (35) for support and attachment of the inked ribbon reels (2, 5).

21. The inked ribbon device according to claim 14, wherein the inked ribbon guide elements (7, 8) are molded, where the where the ink ribbon guide elements define the print path (17) of a print head and form sliding faces (36) and guide indentations (37) for the inked ribbon (6).

* * * * *